US005785098A

United States Patent [19]

Sern et al.

[11] Patent Number: 5,785,098

[45] Date of Patent: Jul. 28, 1998

[54] METHOD AND APPARATUS FOR FILLING CONTAINERS

[75] Inventors: Vincent Kho Yue Sern; See Soon Lee; Chew Kai Hwa, all of Singapore, Singapore

[73] Assignee: Singapore Asahi Chemical & Solder Industries Pte. Ltd., Singapore, Singapore

[21] Appl. No.: 743,949

[22] Filed: Nov. 5, 1996

[51] Int. Cl.[6] ..... B65B 3/12

[52] U.S. Cl. ..... 141/27; 141/18; 141/25; 141/357

[58] Field of Search ..... 141/18, 21–24, 141/25–27, 357, 368

[56] References Cited

U.S. PATENT DOCUMENTS

| | | | |
|---|---|---|---|
| 1,512,060 | 10/1924 | Schmucker | 141/18 |
| 2,253,151 | 8/1941 | Thompson | 141/357 |
| 2,545,605 | 3/1951 | Canine | 141/357 |
| 3,255,788 | 6/1966 | Cook | 141/25 |
| 4,146,067 | 3/1979 | Ziegler | 141/27 |
| 4,483,375 | 11/1984 | Martin | 141/27 |

FOREIGN PATENT DOCUMENTS

| | | |
|---|---|---|
| 2684087 | 5/1993 | France . |
| 2432831A1 | 1/1976 | Germany . |
| 3718948A1 | 12/1988 | Germany . |
| 2169662 | 7/1986 | United Kingdom . |
| WO93/02921 | 2/1993 | WIPO . |
| WO96/31392 | 10/1996 | WIPO . |

OTHER PUBLICATIONS

Austrian Search Report.

European Search Report.

*Primary Examiner*—J. Casimer Jacyna

*Attorney, Agent, or Firm*—Klarquist Sparkman Campbell Leigh & Whinston, LLP

[57] ABSTRACT

A syringe or cartridge has a displaceable stopper located herein, and an apparatus for filling the syringe or cartridge has a reservoir for holding a flowable filling material and a plunger associated with the reservoir to exert pressure on the flowable material in the reservoir. The plunger includes at least one dispensing port defining a channel through the plunger for connection with the syringe or cartridge to be filled. The apparatus also has a pressurizer for applying pressure to the plunger.

16 Claims, 3 Drawing Sheets

METHOD AND APPARATUS FOR FILLING CONTAINERS

FIELD OF THE INVENTION

THIS INVENTION relates to a method and apparatus for filling containers, such as syringes and cartridges, with flowable materials and, more particularly, high viscosity materials, such as solder paste, adhesives and lubricants.

BACKGROUND OF THE INVENTION

Syringes and cartridges for containing such high viscosity flowable materials are formed with a dispensing nozzle at one end and a larger aperture at the other end. In known filling systems, the dispensing nozzle is blocked or sealed whilst the syringe or cartridge is filled through the larger aperture. The filled syringe or cartridge is then sealed by a stopper which is pushed into the larger aperture. To discharge the contents of the syringe, the dispensing nozzle is either unblocked, or the seal broken, and the stopper is pushed into the syringe or cartridge displacing the material in the syringe or cartridge through the dispensing nozzle.

Such known filling systems for filling syringes or cartridges with high viscosity materials require the use of a high pressure pumping system. The high viscosity materials are introduced into the syringe or cartridge through the larger aperture thereof—i.e. not through the dispensing nozzle—and then a stopper is inserted in the end of the syringe or cartridge to prevent air coming into contact with the material within the syringe or cartridge.

SUMMARY OF THE INVENTION

It is an object of the present invention to overcome the problems associated with known filling systems and, accordingly, one aspect of the present invention provides an apparatus for filling a syringe or cartridge comprising: a reservoir for holding a flowable filling material; a plunger associated with the reservoir to exert pressure on the flowable filling material in the reservoir, which plunger includes at least one dispensing port defining a channel through the plunger for connection with a syringe or cartridge to be filled; and means for applying pressure to the plunger.

A further aspect of the present invention provides a method of filling a syringe or cartridge with a flowable filling material from a reservoir, comprising the steps of:

- locating a nozzle of an empty syringe or cartridge in a dispensing port of a plunger associated with the reservoir; and
- applying pressure to the plunger to force filling material from the reservoir through the dispensing port and into the syringe or cartridge through the nozzle.

In order that the present invention may be more readily understood, embodiments thereof will now be described, by way of example, with reference to the accompanying drawings.

DESCRIPTION OF THE INVENTION

Figure 1:
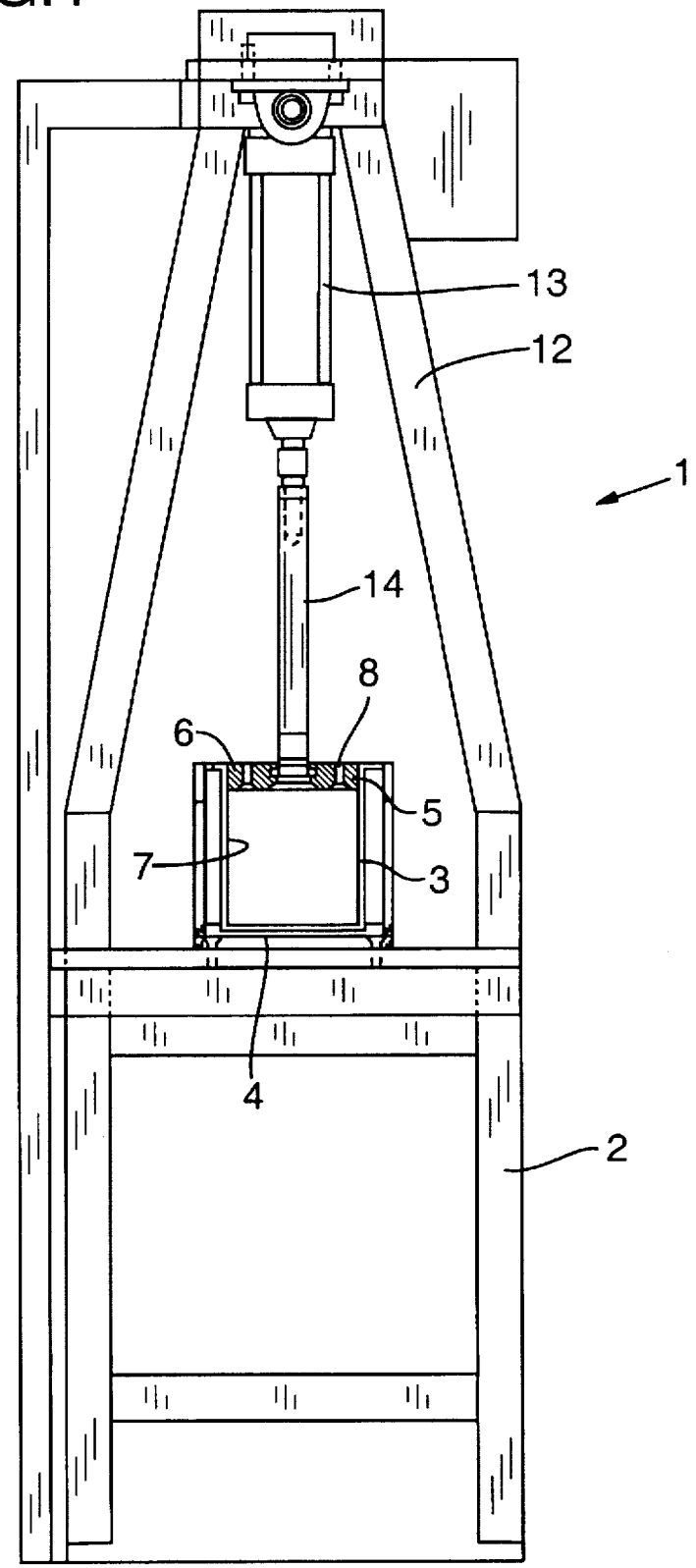
FIG. 1 is an end view of an apparatus embodying the present invention for filling containers with high viscosity flowable material.
Figure 2:
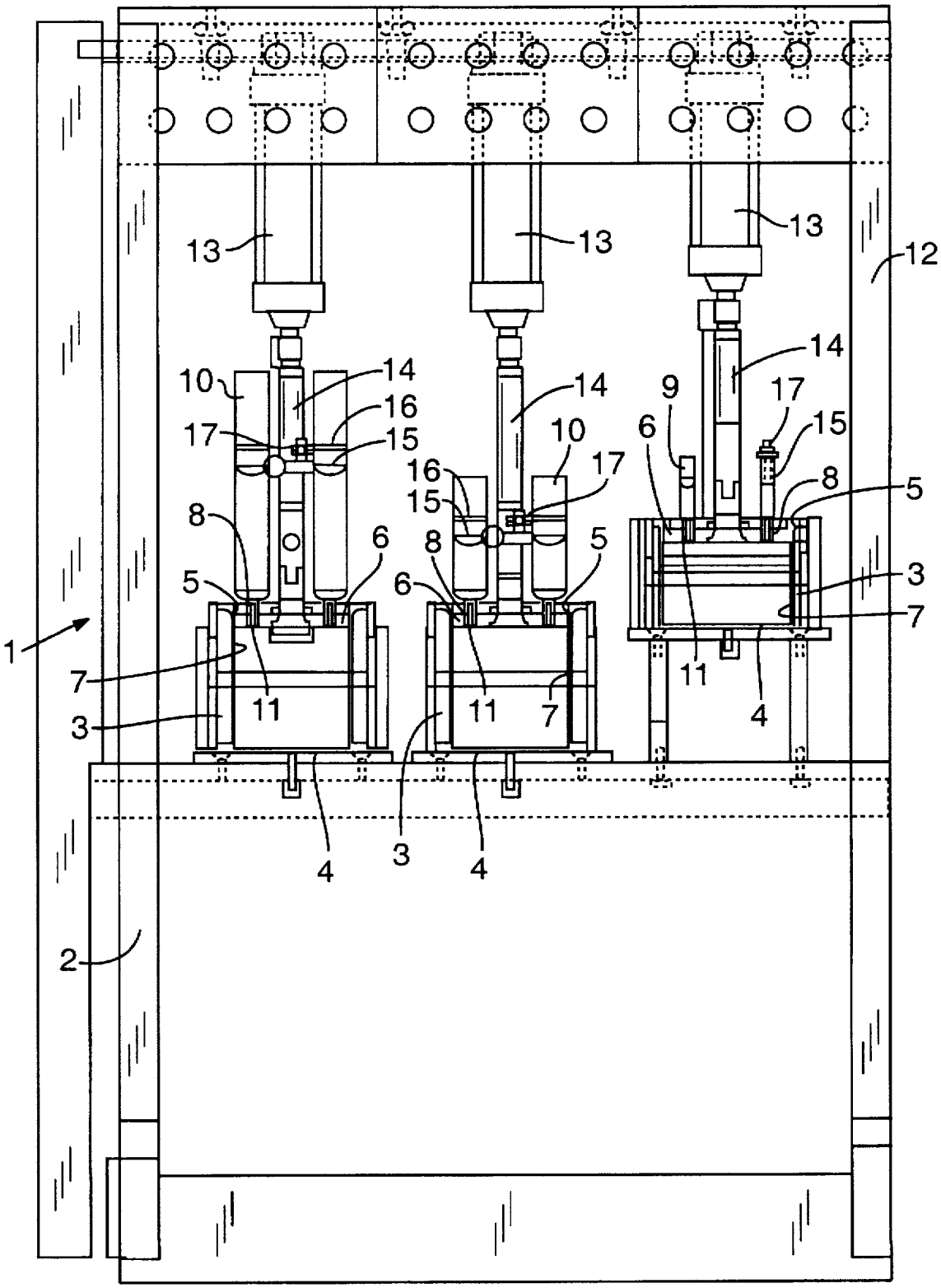
FIG. 2 is a side view of the apparatus of FIG. 1.
Figure 3:
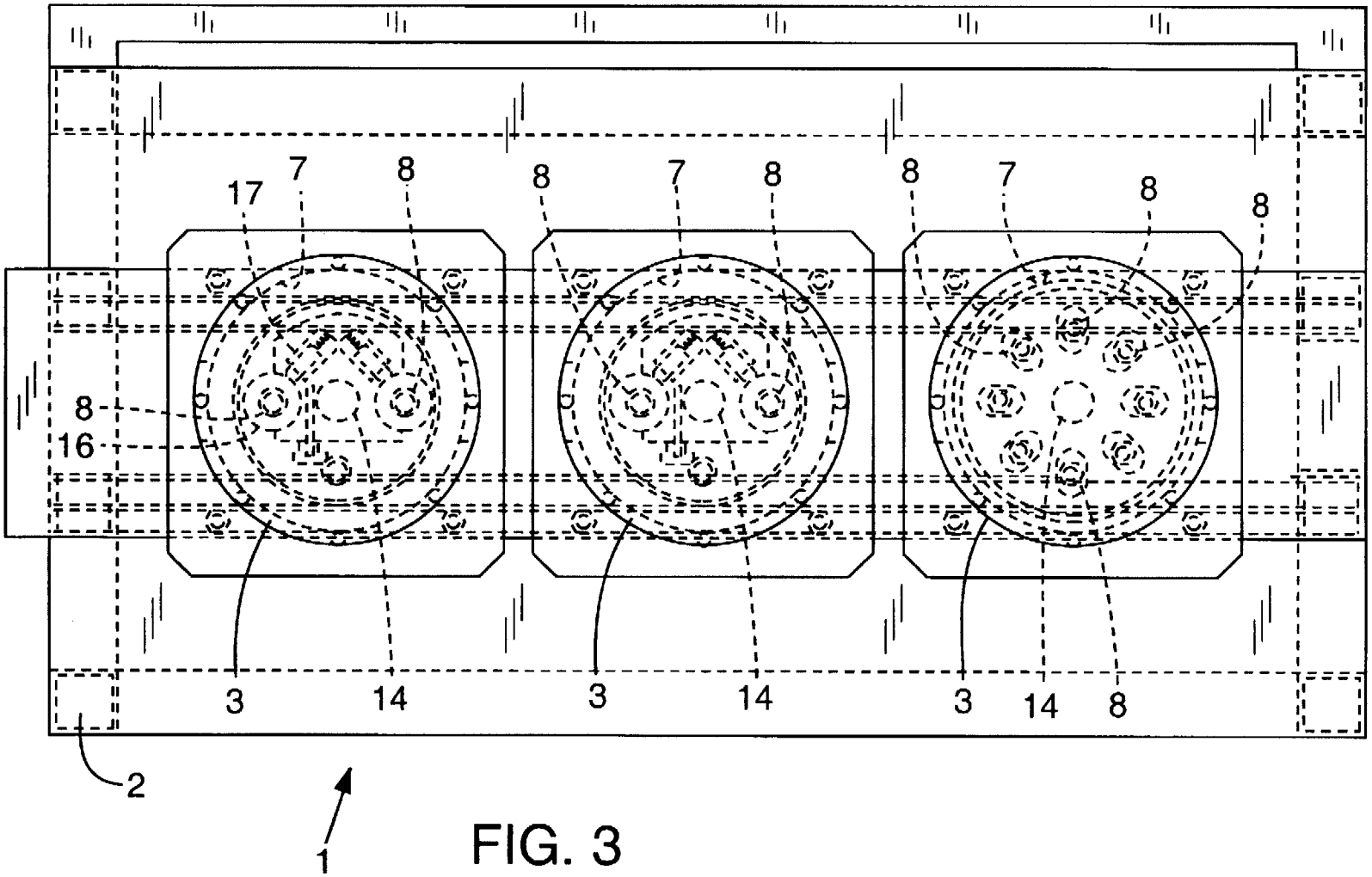
FIG. 3 is a plan view of the apparatus of FIG. 1.

Referring to FIGS. 1, 2 and 3, an apparatus embodying the present invention comprises a filling system 1 which is positioned on a bench platform 2 so that the working parts of the filling system 1 are at an appropriate height for operation, maintenance and service.

The filling system 1 comprises a filling material reservoir 3 which is formed as a stainless steel cylindrical vessel 3 having a closed bottom end 4 and an open top end 5. The vessel 3 is filled with a flowable material which is to be loaded into syringes, cartridges or the like. The open top end 5 of the vessel 3 is sealed by a circular plunger 6. The plunger 6 is accurately sized to provide a hermetic seal with an inner surface 7 of the vessel 3 to ensure that no air can come into contact with the material in the vessel 3. Preferably, O-rings (not shown) are used to ensure an appropriate hermetic seal between the plunger 6 and the vessel 3.

The plunger 6 is provided with an air release valve (not shown) which can be opened to allow any air situated between the material in the vessel 3 and the plunger 6 to be evacuated as the plunger 6 is lowered down to the level of the material within the vessel 3. Once the plunger 6 abuts the material within the vessel 3 and some of the material is forced out through the air release valve, the air release valve is closed. Thus, the plunger 6 is seated directly on the material in the vessel 3, there being no air left in the vessel 3.

The plunger 6 is formed with one or more dispensing ports 8. The or each dispensing port 8 forms a channel between the material in the vessel 3 and a syringe 9 or cartridge 10 to be connected to the or each dispensing port 8.

Each dispensing port 8 is sized to receive a dispensing nozzle 11 of a syringe 9 or cartridge 10.

In the embodiment shown in FIGS. 1, 2 and 3, three separate vessels 3 are located along the bench platform 2. An A-frame 12 is fixed to the bench platform 2 and provides a support frame over the vessels 3. The apex of the A-frame supports three separate pneumatic cylinders 13 each having a piston 14 which projects from its cylinder 13 downwardly towards a respective vessel 3. Each piston 14 is fixed to the centre of the plunger 6 of a respective one of the vessels 3.

Actuation of a cylinder 13 thereby provides movement of the associated plunger 6. Preferably, the pneumatic cylinders 18 are operated by compressed air supplied by an air compressor and the pressure applied by the cylinders 13 to the plungers 6 is controllable in dependence on the viscosity of the material within the vessels 3.

Each syringe 9 or cartridge 10, when empty, is provided with a stopper 15 which is located in the syringe 9 or cartridge 10 immediately adjacent the dispensing nozzle 11 thereof.

A stainless steel stop ring 16 is placed on top of each stopper 15.

An end stop sensor 17 is mounted, preferably, on the piston 14. The end stop sensor 17 is operable to detect the presence of the stainless steel stop ring 16 on top of the stopper 15.

In operation, the plunger 6 is seated directly on top of the material in the vessel 3 and the air release valve is closed. The dispensing nozzle 11 of a syringe 9 or cartridge 10 is inserted into a dispensing port 8 in a plunger 6. The nozzle 11 is hermetically sealed with respect to the dispensing port 8. The pneumatic cylinder 13 linked to the plunger 6 is actuated to cause pressure to be applied to the plunger 6 by the piston 14. The plunger 6 thereby increases the pressure on the material within the vessel 3 forcing the material up through the dispensing port 8 and through the dispensing nozzle 11 into the syringe 9 or cartridge 10.

As the material is forced into the syringe 9 or cartridge 10 through the nozzle 11, the stopper 15 is forced upwardly in the syringe 9 or cartridge 10 as the volume of material in the syringe 9 or cartridge 10 increases. The stainless steel stop ring 16 thereby moves up the syringe 9 or cartridge 10 with the stopper 15 as the syringe 9 or cartridge 10 is filled. The stainless steel stop ring 16 eventually comes into contact with the end stop sensor 17 which detects the presence of the stainless steel stop 16 ring by, for example, the stainless steel stop ring 16 completing an electric circuit with the sensor 17. This indicates that the syringe 9 or cartridge 10 is full and a signal is sent to stop pressure being applied by the pneumatic cylinder 13 to the plunger 6. The height of the end stop sensor may be varied so that the syringe or cartridge is filled to a selected volume.

The filled syringes 9 or cartridges 10 are then detached from the dispensing ports 8 for subsequent usage.

When the supply of filling material in a container 3 has been exhausted, the plunger 6 may be lifted back up the vessel 3 with the air release valve opened to ensure that no material in partly filled syringes 9 or cartridges 10 is sucked backwards into the vessel 3 by the reduced pressure in the container 3 caused by the movement of the plunger 6 up the vessel 3.

Preferably, as shown in the left hand side and middle filling systems of FIGS. 2 and 3, the sensor 17 is provided on the piston 14, although different embodiments are possible whereby the sensor 17 is mounted on the top of the syringe 9 or cartridge 10 to contact the stainless steel stop ring 16 as it rises within the syringe 9 or cartridge 10.

The plan view of FIG. 3 shows how the configuration of dispensing ports 8 on a plunger 6 may be adapted to accommodate different sizes and numbers of syringes 9 or cartridges 10 which are to be filled. The plungers 6 in the left hand side and middle filling systems of FIGS. 2 and 3 can each accommodate two cartridges 10, whilst the right hand side filling system can accommodate eight syringes 9 using an array of dispensing ports 8 located around the centre of the plunger 6.

As previously mentioned, the pressure required to fill a syringe or cartridge with a high viscosity flowable material using embodiments of the present invention is dependent upon the viscosity of the filling material. In the case of a solder paste having a viscosity of 1100 kcPs, the pressure required to be exerted on the plunger 6 is in the region of 110 psi (758 $kN/m^2$).

The above described apparatus and method is particularly useful for filling syringes 9 or cartridges 10 or the like with high viscosity flowable materials such as solder paste, adhesives, lubricants etc.

It is envisaged that the plurality of vessels 3 shown in FIGS. 2 and 3 may be replaced by a single supply tank constituting a reservoir for the filling material. The single tank has a number, three in the present example, of upwardly extending cylindrical sleeves each for receiving a respective plunger 6.

The features disclosed in the foregoing description in the following claims and/or in the accompanying drawings may, both separately and in combination thereof, be material for realising the invention in diverse forms thereof.

The invention claimed is:

1. A syringe or cartridge having a displaceable stopper located therein; and an apparatus for filling the syringe or cartridge, the apparatus comprising;

a reservoir for holding a flowable filling material;

a plunger associated with the reservoir to exert pressure on the flowable material in the reservoir, which plunger includes at least one dispensing port defining a channel through the plunger for connection with the syringe or cartridge;

means for applying pressure to the plunger; and a sensor mounted on the means for applying pressure to the plunger and operably associated with the stopper to sense displacement of the stopper by a predetermined amount.

2. An apparatus according to claim 1, wherein the or each dispensing port is adapted to sealingly receive a dispensing nozzle of a syringe or cartridge.

3. An apparatus according to claim 1, wherein the means for applying pressure to the plunger applies, in use, the pressure in the opposite direction to that in which the filling material enters a syringe or container when such pressure is applied.

4. An apparatus according to claim 1, wherein the means for applying pressure to the plunger comprises a pneumatic cylinder.

5. An apparatus according to claim 4, wherein the plunger is attached to a piston of the pneumatic cylinder for applying pressure to the plunger.

6. An apparatus according to claim 1, wherein the plunger and the reservoir are hermetically sealed with respect to one another.

7. An apparatus according to claim 1, wherein the stopper includes a stop member that is displaced along with the stopper and that contacts the sensor when the syringe or cartridge is filled to predetermined amount.

8. A method for filling a syringe or cartridge with a flowable filling material from a reservoir, comprising the steps of:

locating a nozzle of an empty syringe or cartridge in a dispensing port of a plunger associated with the reservoir;

providing a means for applying pressure to the plunger;

applying pressure to the plunger to force filling material from the reservoir through the dispensing port and into the syringe or cartridge through the nozzle;

providing a stopper in the empty syringe or cartridge adjacent to the nozzle of the syringe or cartridge;

providing a sensor mounted on the means for applying pressure to the plunger and associated with the stopper;

sensing the displacement of the stopper; and upon displacement of the stopper by a predetermined amount, generating a signal to stop application of pressure to the plunger.

9. A method according to claim 8, wherein pressure is applied to the plunger in the opposite direction to that in which the filling material enters the syringe or container through the nozzle thereof.

10. An apparatus for filling a syringe or cartridge having a displaceable scopper, the apparatus comprising:

a reservoir for holding a flowable filling material;

a plunger associated with the reservoir to exert pressure on the flowable material in the reservoir, which plunger includes at least one dispensing port defining a channel through the plunger for connection with a syringe or cartridge to be filled;

means for applying pressure to the plunger; and a sensor mounted on the means for applying pressure to the plunger and operably associated with the stopper to sense displacement of the stopper by a predetermined amount.

11. An apparatus according to claim 10, wherein the or each dispensing port is adapted to sealingly receive a dispensing nozzle of a syringe or cartridge.

12. An apparatus according to claim 10, wherein the means for applying pressure to the plunger applies, in use, the pressure in the opposite direction to that in which the filling material enters a syringe or container when such pressure is applied.

13. An apparatus according to claim 10, wherein the means for applying pressure to the plunger comprises a pneumatic cylinder.

14. An apparatus according to claim 13, wherein the plunger is attached to a piston of the pneumatic cylinder for applying pressure to the plunger.

15. An apparatus according to claim 10, wherein the plunger and the reservoir are hermetically sealed with respect to one another.

16. An apparatus according to claim 10, wherein the stopper includes a stop member that is displaced along with the stopper and that contacts the sensor when the syringe or cartridge is filled to the predetermined amount.

* * * * *

UNITED STATES PATENT AND TRADEMARK OFFICE

CERTIFICATE OF CORRECTION

PATENT NO. : 5,785,098

DATED : July 28, 1998

INVENTOR(S) : Vincent Kho Yue Sern; See Soon Lee; Chew Kai Hwa

It is certified that error appears in the above-identified patent and that said Letters Patent is hereby corrected as shown below:

On the title page item [57],

Line 2, change "herein" to --therein--.

In the Claims:

Column 4, line 31 change "to predetermined" to read --to the predetermined--.

Column 4, line 56 change "scopper" to --stopper--.

Signed and Sealed this

Fourteenth Day of September, 1999

*Attest:*

Q. TODD DICKINSON

*Attesting Officer*

*Acting Commissioner of Patents and Trademarks*